US012345018B2

(12) United States Patent
Tsuchie

(10) Patent No.: US 12,345,018 B2
(45) Date of Patent: Jul. 1, 2025

(54) WORK MACHINE AND WORK MACHINE SYSTEM

(71) Applicant: HITACHI CONSTRUCTION MACHINERY CO., LTD., Tokyo (JP)

(72) Inventor: Yoshiyuki Tsuchie, Matsudo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 121 days.

(21) Appl. No.: 18/279,413

(22) PCT Filed: Mar. 16, 2022

(86) PCT No.: PCT/JP2022/011785

§ 371 (c)(1),
(2) Date: Aug. 30, 2023

(87) PCT Pub. No.: WO2022/215466

PCT Pub. Date: Oct. 13, 2022

(65) Prior Publication Data

US 2024/0191472 A1 Jun. 13, 2024

(30) Foreign Application Priority Data

Apr. 9, 2021 (JP) ..... 2021-066428

(51) Int. Cl.
*E02F 9/00* (2006.01)
*E02F 9/20* (2006.01)
(Continued)

(52) U.S. Cl.
CPC ..... *E02F 9/2033* (2013.01); *E02F 9/205* (2013.01); *E02F 9/24* (2013.01); *E02F 9/26* (2013.01); *E02F 9/268* (2013.01)

(58) Field of Classification Search
None
See application file for complete search history.

(56) References Cited

U.S. PATENT DOCUMENTS

2013/0268138 A1* 10/2013 Moughler ..... G05D 1/027 701/2
2014/0222247 A1* 8/2014 Friend ..... G05D 1/0276 701/2

(Continued)

FOREIGN PATENT DOCUMENTS

JP 2004-338817 A 12/2004
JP 2013-150233 A 8/2013

(Continued)

OTHER PUBLICATIONS

International Search Report of PCT/JP2022/011785 dated Jun. 7, 2022.

*Primary Examiner* — James M McPherson
(74) *Attorney, Agent, or Firm* — MATTINGLY & MALUR, PC

(57) ABSTRACT

Provided are a work machine and a work machine system that reduce risk that a vehicle body comes into contact with an obstacle nearby in a case wherein abnormality arises in the work machine. The work machine comprises: a traveling body; a rotary body rotatably mounted onto the traveling body; a work machinery of an articulated type mounted to the rotary body and including a boom, an arm and a work tool; and a control device. The control device comprises a control instruction calculation section, a machine control section, an abnormality detection section, an avoiding movement necessity determination section and an avoidance control instruction section. The machine control section controls the traveling body, the rotary body and the work machinery putting priority on the avoidance control instruction over the operation control instruction.

10 Claims, 4 Drawing Sheets

(51) Int. Cl.
*E02F 9/24* (2006.01)
*E02F 9/26* (2006.01)

(56) References Cited

U.S. PATENT DOCUMENTS

| | | | | |
|---|---|---|---|---|
| 2015/0198936 | A1* | 7/2015 | McGee | G05D 1/0061 700/40 |
| 2020/0057437 | A1 | 2/2020 | Minagawa et al. | |
| 2020/0174465 | A1 | 6/2020 | Minagawa et al. | |
| 2020/0199853 | A1 | 6/2020 | Konda et al. | |
| 2021/0040710 | A1* | 2/2021 | Tanaka | E02F 9/261 |
| 2024/0011245 | A1* | 1/2024 | Onodera | E02F 9/205 |

FOREIGN PATENT DOCUMENTS

| | | | |
|---|---|---|---|
| JP | 2017-218015 | A | 12/2017 |
| JP | 2019-065657 | A | 4/2019 |
| JP | 2019-065661 | A | 4/2019 |
| JP | 2019-068346 | A | 4/2019 |
| JP | 2021-035812 | A | 3/2021 |

* cited by examiner

WORK MACHINE AND WORK MACHINE SYSTEM

TECHNICAL FIELD

The present invention relates to a work machine and a work machine system.

BACKGROUND ART

As back ground art, there is JP 2019-68346 A (Patent Literature 1). Patent Literature 1 describes "a work vehicle comprises: an imaging device for capturing an image showing a work object; an image transmission section for transmitting the image captured by the imaging device to a control device; an operation signal receiving section for receiving an operation signal from the control device; and a movement control section for restricting the operation signal in response to transmission situation of the image".

Also, as other background art, there is JP 2019-065661 (Patent Literature 2). Patent Literature 2 describes "a loading equipment control device for controlling loading equipment comprising a rotary body rotating around a rotation center and a work machine including a bucket and mounted to the rotary body, wherein the load equipment control device comprises: a loaded machine information obtaining section for obtaining position information and direction information of a loaded machine; soil removal position identification section for identifying a soil removal position wherein soil is loaded to the loaded machine based on the position information and the direction information; a bucket position identification section for identifying a position of the bucket when a soil removal signal for moving the bucket to the soil removal position is inputted; and an operation signal generation section for generating an operation signal for moving the bucket from the identified position to the soil removal position.

CITATION LIST

Patent Literature

Patent Literature 1: JP 2019-068346 A
Patent Literature 2: JP 2019-065661 A

SUMMARY OF INVENTION

Technical Problem

Patent Literature 1 describes a mechanism for restricting the operation signal under a situation wherein abnormality arises in image transmission and the operator cannot operate the work machine appropriately.

However, even if the operation signal is restricted during operating a vehicle body and vehicle body speed is lowered, inertia of the vehicle body might cause contacting with an obstacle nearby.

Also, in Patent Literature 2 describes a mechanism for avoiding coming into contact with a hauling vehicle without any operation of an operator by identifying a vehicle position, a direction and a soil removal position.

However, it is desirable that coming into contact can be avoided even in cases wherein abnormality arises in a device for identifying the soil removal position, the vehicle position, the direction, etc.

In view of the above, an object of the present invention is to reduce a risk of coming into contact with an obstacle nearby even if the vehicle body does not stop immediately due to inertia in a case wherein abnormality arises in a work machine.

Solution to Problem

A work machine related to the present invention is characterized in that it comprises:

- a traveling body;
- a rotary body rotatably mounted onto the traveling body;
- a work machinery of an articulated type mounted to the rotary body and including a boom, an arm and a work tool; and
- a control device, wherein the control device comprises:

- a control instruction calculation section for calculating an operation control instruction to the traveling body, the rotary body and the work machinery in response to an operation instruction outputted from an operation input device;
- a machine control section for controlling the traveling body, the rotary body and the work tool in response to an operation control instruction of the control instruction calculation section;
- an abnormality detection section for detecting abnormality of a signal from outside of the work machine or abnormality of the work machine;
- an avoiding movement necessity determination section for distinguishing movement situation of the traveling body, the rotary body and the work machinery and determining whether an avoiding movement, which is a movement to change a moving direction of the work machinery to a predetermined direction avoiding coming into contact with an obstacle, is necessary in a case wherein the abnormality detection section detects abnormality; and
- an avoidance control instruction section for calculating an avoidance control instruction and outputs this to the machine control section in a case wherein it is determined that the avoiding movement is necessary by the avoiding movement necessity determination section, wherein the machine control section controls the traveling body, the rotary body and the work machinery putting priority on the avoidance control instruction over the operation control instruction.

The present description includes the disclosure of Japanese Patent Application No. 2021-066428, which is the basis of the priority of the present application.

Advantageous Effects of Invention

According to the present invention, the risk that the vehicle body comes into contact with an obstacle nearby is reduced in a case wherein abnormality arises in a work machine.

DESCRIPTION OF EMBODIMENTS

Example 1

Figure 1:
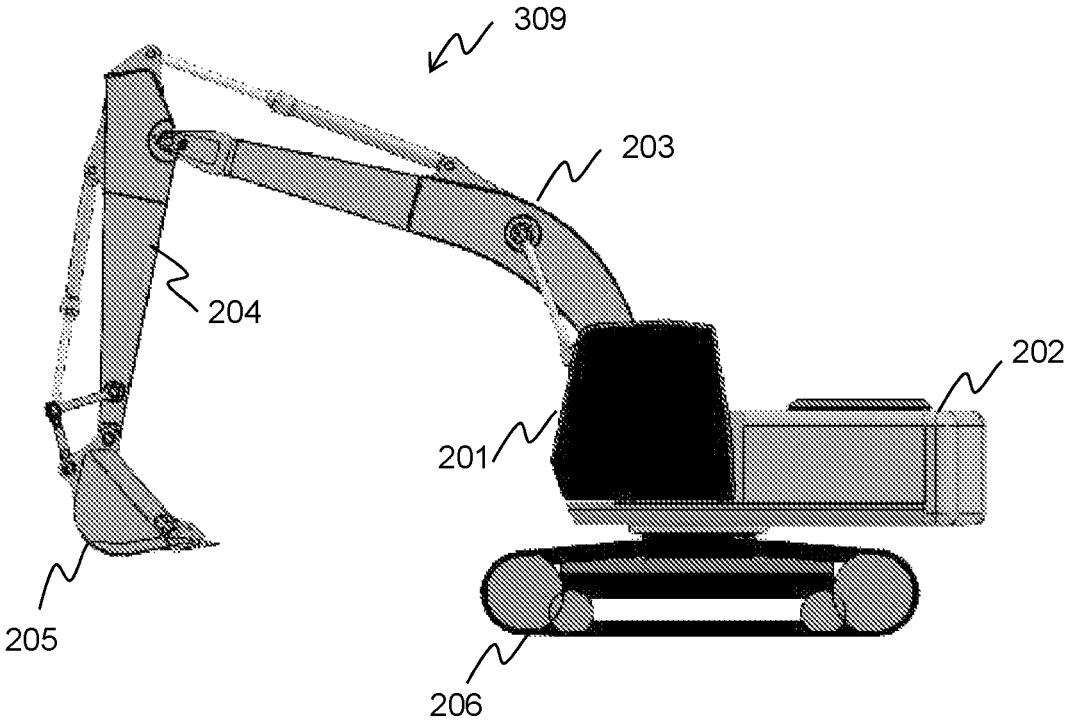
FIG. 1 is a shovel of Example 1.

An target of the present example is vehicle body control when abnormality arises in remote control of a shovel (work machine) such as shown in FIG. 1. The shovel comprises: a rotary body 202 including a cab 201; a traveling body 206; and a work machinery 309 including a boom 203, an arm 204 and a bucket 205. The rotary body 202 is rotatably mounted onto the traveling body 206. The work machinery 309 is mounted to the rotary body 202, includes the boom 203, the arm 204 and a work tool, and is constructed to be an articulated type. The work tool is the bucket 205 in this example, but this may be a hydraulics breaker/chisel, a crusher, a steel framed reinforced concrete dismantler, a reinforcing steel cutter, a fork, a fork grapple, a mounted hydraulic auger, a grass cutter, a bucket hammer, a magnet, etc.

Figure 2:
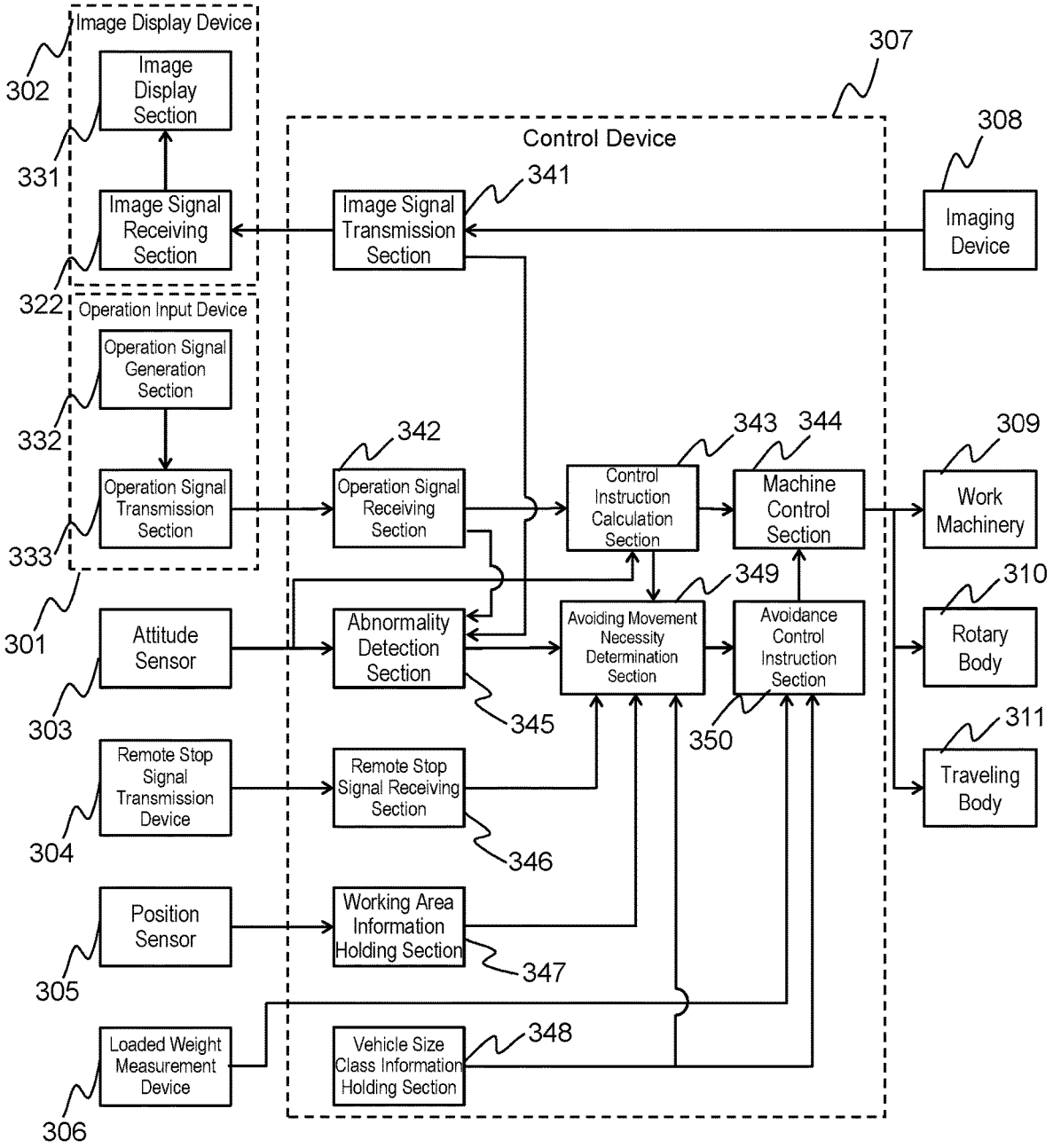
FIG. 2 is a system block diagram of Example 1.

FIG. 2 is a system block diagram of the present example. The work machine (for example, a shovel) comprises a control device 307, an imaging device 308, the work machinery 309, a rotary body 310 and a traveling body 311. Also, the work machine comprises an attitude sensor 303, a position sensor 305 and a loaded weight measurement device 306.

Also, the work machine system related to the present example comprises: the above work machine; an operation input device 301 provided outside the work machine; an image display device 302; and a remote stop signal transmission device 304. They output signals to the control device 307. The remote stop signal transmission device 304 is a device for transmitting an emergency stop signal that instructs emergency stop of the work machine and is used, for example, by a worker nearby the work machine in order to avoid an accident by the work machine.

The operation input device 301 may be a portion of the work machine or located outside the work machine. If it is located outside the work machine, the operation input device 301 receives an input from a remote operator.

The operation input device 301 comprises an operation signal generation section 332 for generating an operation signal in response to an operation of an operator and an operation signal transmission section 333 for transmitting the operation signal to the work machine. Also, the work machine comprises an imaging device 308 for capturing an image around the work machine.

The control device 307 comprises an operation signal receiving section 342 and an image signal transmission section 341. The operation signal receiving section 342 receives the operation signal transmitted by the operation signal transmission section 333 and outputs this to the control instruction calculation section 343. The image signal transmission section 341 transmits the image signal outputted by the imaging device 308 to an outside of the work machine (in this example, to the image display device 302).

The image display device 302 comprises an image signal receiving section 322 for receiving the image signal transmitted by the image signal transmission section 341 and an image display section 331 for outputting an image to the operator.

The operator of the shovel confirms a situation around the shovel by the image captured by the imaging device 308 and outputted by the image display device 302. Also, the operator operates the work machinery 309, the rotary body 310 and the traveling body 311 from remote via the operation input device 301.

The image captured by the imaging device 308 is transmitted from the image signal transmission section 341 of the control device 307 to the outside of the vehicle and received by the image signal receiving section 322 of the image display device 302. The received image signal is outputted to the operator via the image display section 331.

Also, the operation input device 301 has an operation lever. If the operator operates the lever, the operation signal generation section 332 outputs an operated angle of the lever as the operation signal. The operation signal is transmitted to the shovel via the operation signal transmission section 333 and received by the operation signal receiving section 342 of the shovel. The operation signal is transformed into an operation control instruction such as an instructed pressure by the control instruction calculation section 343.

The control instruction calculation section 343 calculates the operation control instructions to the rotary body 310, the traveling body 311 and the work machinery 309 in response to the operation instruction outputted from the operation input device 301.

The control instruction calculation section 343 also modifies the operation control instruction so as to stop movement toward a position of a preset specific obstacle based on a vehicle attitude sensed by the attitude sensor 303 as well as the operation signal. The position of the specific obstacle may be stored, for example, in a storage means of the control device 307. The specific obstacle herein is, for example, a footing for loading soil to a dump car. If the operator operates the work machinery without noticing the footing, the control instruction calculation section 343 determines whether the work machinery 309, the rotary body 310 or the traveling body 311 comes into contact with the footing if it is controlled according to the operation.

If it is determined that it comes into contact, the control instruction calculation section 343 does not perform the control according to the operation (i.e. without coming into contact with the footing), and it stops movement of the work machinery 309, the rotary body 310 or the traveling body 311. Such control can be realized as needed by those skilled in the art based on known techniques or the like. Note that avoiding the obstacle by an operation of the operator is also advantageous because the position of the dump car changes with time.

The control instruction calculation section 343 calculates an operation control instruction in response to attitude information detected by the attitude sensor 303. For example, it determines whether a specific operation may be performed in response to the attitude of the work machine, and outputs or stops the operation control instruction in response to the result.

The machine control section 344 controls the work machinery 309, the rotary body 310 and the traveling body 311 in response to the operation control instruction of the control instruction calculation section 343.

An abnormality detection section 345 detects abnormality of a signal from outside the work machine or abnormality of the work machine.

Figure 3:
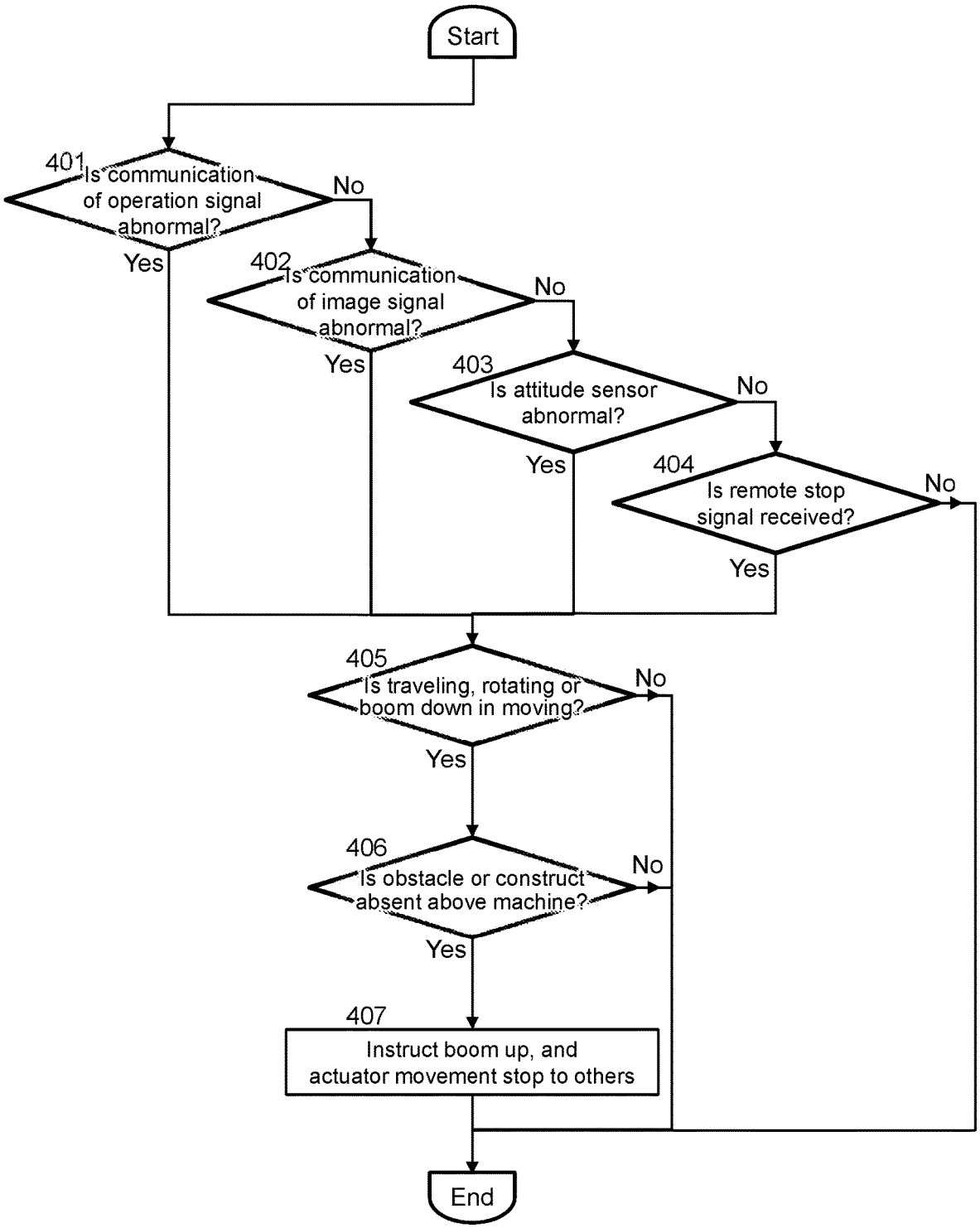
FIG. 3 is a flowchart of Example 1.

A process of the present example is shown in the flowchart of FIG. 3. Hereinafter, the present example is explained according to the flowchart. The process shown in this flowchart is performed, for example, by the control device 307.

In Steps 401-403 of FIG. 3, the abnormality detection section 345 detects the abnormality of a signal from outside or the abnormality of the work machine.

In Step 401, it is determined whether there is abnormality in communication of the operation signal. The abnormality herein includes, communication breakdown, communication delay equal to or longer than a predetermined time, a bit error in the operation signal, abnormality of acknowledgment, etc., between the operation signal transmission section 333 and the operation signal receiving section 342. For example, the abnormality detection section 345 detects communication delay, communication breakdown or loss of communication data arisen between the operation signal transmission section 333 and the operation signal receiving section 324 as the abnormality. If it is determined that there is abnormality, the process proceeds to Step 405. If it is determined that there is no abnormality, the process proceeds to Step 402.

In Step 402, it is determined whether there is abnormality in communication of the image signal. The abnormality herein includes, communication breakdown, communication delay equal to or longer than a predetermined time, a bit error in the image signal, abnormality of acknowledgment, etc., between the image signal transmission section 341 and the image signal receiving section 322. For example, the abnormality detection section 345 detects communication delay, communication breakdown or loss of communication data arisen between the image signal transmission section 341 and the image signal receiving section 322 as the abnormality. If it is determined that there is abnormality, the process proceeds to Step 405. If it is determined that there is no abnormality, the process proceeds to Step 403.

Abnormality in communication of the operation signal or the image signal can be detected appropriately by such abnormality detection criteria.

In Step 403, it is determined whether there is abnormality in the attitude sensor 303. The work machine comprises the attitude sensor 303. The attitude sensor 303 detects attitude information representing attitude of the work machine. The attitude sensor includes, for example, a potentiometer of a variable resistor type and an IMU (Inertial Measurement Unit). If it is determined that there is abnormality, the process proceeds to Step 405. If it is determined that there is no abnormality, the process proceeds to Step 404.

The control instruction calculation section 343 calculates the operation control instruction in response to the attitude information detected by the attitude sensor 303. For example, it determines whether a specific operation may be performed in response to the attitude of the work machine, and outputs or stops the operation control instruction in response to the result.

The abnormality detection section 345 detects signal loss or precision deterioration of the attitude sensor 303 as abnormality. Also, if the sensor output is an analog signal, the abnormality of the attitude sensor 303 may be breaking of wire or deviation from a predetermined signal level. If the sensor output is a digital signal, the abnormality of the attitude sensor 303 may be communication breakdown, deviation from predetermined communication content, receiving of a signal indicating internal abnormality, etc. Abnormality of the attitude sensor 303 can be detected appropriately by such detection criteria.

In Step 404, the remote stop signal receiving section 346 determines whether an emergency stop signal is received. The remote stop signal receiving section 346 can receive the emergency stop signal. The emergency stop signal is transmitted and received, for example, as a remote signal. If it is determined that there is abnormality, the process proceeds to Step 405. If it is determined that there is no abnormality, the process is terminated.

In a case wherein the abnormality detection section 345 detects abnormality in any of Steps 401-403 or in a case wherein the remote stop signal receiving section 346 receives the emergency stop signal in Step 404, an avoiding movement necessity determination section 349 distinguishes movement situation of the traveling body 311, the rotary body 310 and the work machinery 309 and determines whether avoiding movement is necessary (Steps 405 and 406 explained later).

Appropriate determination of the avoiding movement is enabled by such specific determination criteria.

For example, in a case wherein the abnormality detection section 345 detects abnormality, the avoiding movement necessity determination section 349 determines that an avoiding movement is necessary if: an instruction to move to rotate the rotary body 310, an instruction to move to travel the traveling body 311, or an instruction to move the boom 203 in a downward direction is being outputted from control the instruction calculation section 343; or the time period after an instruction to move to rotate the rotary body 310, an instruction to move to travel the traveling body 311, or an instruction to move the boom 203 in a downward direction is being outputted from the control instruction calculation section 343; or the time period after an instruction to move to rotate the rotary body 310, an instruction to move to travel the traveling body 311, or an instruction to move the boom 203 in a downward direction is last outputted and before the abnormality detection section 345 detects the abnormality is equal to or less than a first time period. The avoiding movement is a movement for avoiding coming into contact with an obstacle nearby even if the vehicle body does not stop immediately due to inertia even if the operation signal is restricted during vehicle body operation and the speed of the vehicle body is lowered. This is a movement to change a moving direction of the boom, the arm and the bucket to a predetermined direction avoiding coming into contact with the obstacle in order to avoid the boom, the arm and the bucket coming into contact with the obstacle by a rotating movement, a travelling movement and a movement of the boom in a downward direction, that is, it is a movement of the boom, the arm and the bucket in a predetermined direction wherein there is no obstacle. Also, an avoidance control instruction is an instruction of a movement to change a moving direction of the boom, the arm and the bucket to a direction avoiding coming into contact with the obstacle, that is, an instruction to move the boom, the arm and the bucket in a predetermined direction wherein there is no obstacle, and it includes an instruction to move the boom 203 in an upward direction (for example, during a predetermined time period).

In Step 405, the avoiding movement necessity determination section 349 determines whether there is movement of the rotary body 310, whether there is movement of the traveling body 311 or whether there is movement of the boom 203 in a downward direction. If it is determined that there is any of the movements, the process proceeds to Step 406. If it is determined that there is not any of the movements, the process is terminated.

In Step 406, it may be determined whether there is a construct and/or an obstacle above the work machine. If there is the construct and/or the obstacle, the process proceeds to Step 407. If there is no construct and/or obstacle, the process is terminated.

In Step 407 (that is, in a case wherein it is determined by the avoiding movement necessity determination section 349 that the avoiding movement is necessary), the avoidance control instruction section 350 calculates an avoidance control instruction and outputs this to the machine control section 344.

The emergency stop signal may be processed in a similar manner. For example, in Step 404, if the remote stop signal receiving section 346 receives the emergency stop signal, the avoiding movement necessity determination section 349 determines that an avoiding movement is necessary if: an instruction to move to rotate the rotary body 310, an instruction to move to travel the traveling body 311, or an instruction to move the boom 203 in a downward direction is being outputted from the control instruction calculation section 343; or the time period after an instruction to move the rotary body 310, an instruction to move the traveling body 311, or an instruction to move the boom 203 in a downward direction is last outputted and before the remote stop signal receiving section 346 receives the emergency stop signal is equal to or less than a first time period. Also, an avoidance control instruction is an instruction of a movement to change a moving direction of the boom, the arm and the bucket to a predetermined direction avoiding coming into contact with the obstacle, that is, an instruction to move the boom, the arm and the bucket in a predetermined direction wherein there is no obstacle, and it includes an instruction to move the boom 203 in an upward direction (for example, during a predetermined time period).

Such determination criteria enables appropriate determination considering a free running time (for example, the time period after an instruction to move the boom 203 is outputted and before it is determined that the avoiding movement is necessary). In particular, considering the elapsed time after it is last outputted, it can be determined appropriately whether the avoiding movement is necessary even in a modified example wherein the sensor for detecting a situation of the work machine is not provided.

A specific example will be explained using Step 405. In Step 405, the avoiding movement necessity determination section 349 determines whether there is movement of the rotary body 310, whether there is movement of the traveling body 311 and whether there is movement of the boom 203 in a downward direction. All of them are movement that raises risk that the work machinery 309 comes into contact with an obstacle around the vehicle body.

Figure 4:
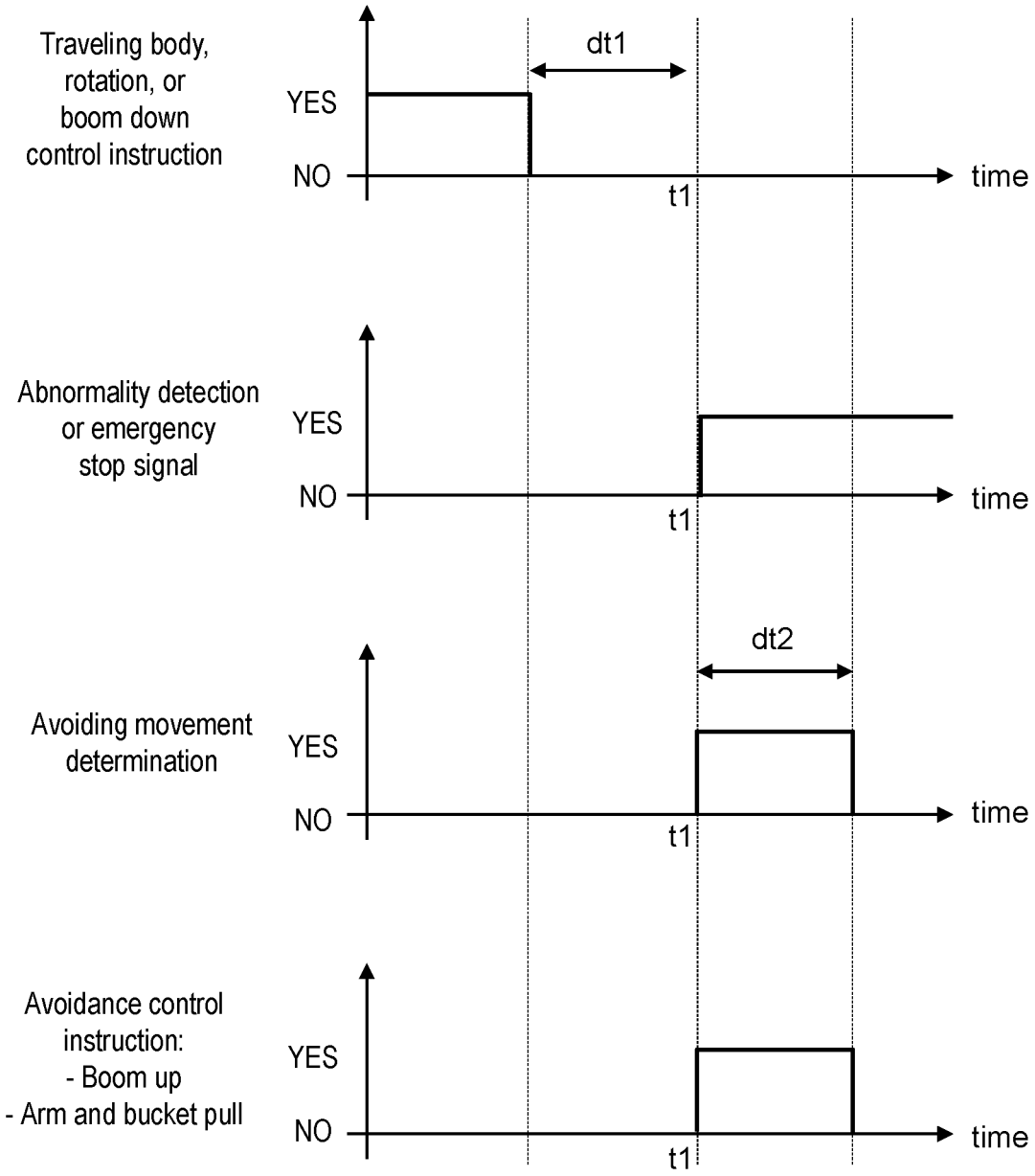
FIG. 4 is avoidance control of Example 1.

A specific example of determination method will be explained using FIG. 4. In Steps 401-404, the time instant of abnormality detection or the time instant of receiving the emergency stop signal is denoted as time instant t1. At this time, the elapsed time from the time instant at which traveling of the traveling body 311, rotation of the rotary body 310 or downward movement of the boom 203 is last instructed to the time instant t1 is denoted as dt1.

Free running time wherein the vehicle body does not stop immediately and the movement continues may occur after the operation control instruction is stopped. Accordingly, if dt1 is shorter than a predetermined time period (first time period), it is determined that the avoiding movement for avoiding the vehicle body coming into contact with an obstacle nearby by free running is necessary.

Also, if inertia of the vehicle body and/or the load is large, the free running time wherein the vehicle body does not stop immediately and the movement continues after the operation control instruction is stopped is long. Accordingly, it may be designed so that it is determined that the avoiding movement for avoiding the vehicle body coming into contact with an obstacle nearby by free running is necessary if dt1 is shorter than a predetermined time period (second time period) corresponding to a vehicle class of the work machine and/or a weight of the load held in the vehicle class information holding section 348 (FIG. 2).

That is, the control device 307 may comprise the vehicle class information holding section 348 that holds vehicle class information of the work machine. And/or, the work machine may comprise the loaded weight measurement device 306 for detecting the loaded weight of the load that is loaded into the work machine. Then, in Steps 401-403, in a case wherein the abnormality detection section 345 detects abnormality, the avoiding movement necessity determination section 349 determines that the avoiding movement, which is a movement to change a moving direction of the boom, the arm and the bucket to a predetermined direction avoiding coming into contact with an obstacle in order to avoid the boom, the arm and the bucket coming into contact with the obstacle by free running, that is, a movement in a predetermined direction wherein there is no obstacle, is necessary if: an instruction to move the rotary body 310 or an instruction to move the boom 203 in a downward direction is being outputted from the control instruction calculation section 343; or the time period after an instruction to move to rotate the rotary body 310 or an instruction to move the boom 203 in a downward direction is last outputted and before the abnormality detection section 345 detects the abnormality is equal to or less than the second time period corresponding to the vehicle class information and/or the loaded weight. Also, the avoidance control instruction is an instruction of a movement to change a moving direction of the boom, the arm and the bucket to a predetermined direction avoiding coming into contact with the obstacle, that is, an instruction to move them in a predetermined direction wherein there is no obstacle, during a predetermined time period (third time period) corresponding to the vehicle class information and/or the loaded weight, and it includes an instruction to move the boom 203 in an upward direction.

The avoidance control instruction outputted during the third time period may include an instruction to move the arm 204 and the bucket 205 in a pull direction. Such a control instruction reduces a rotation radius of the work machinery 309, thereby reducing risk of coming into contact with the obstacle nearby.

The emergency stop signal may be processed in a similar manner. For example, in Step 404, if the remote stop signal receiving section 346 receives the emergency stop signal, the avoiding movement necessity determination section 349 determines that an avoiding movement is necessary if: an instruction to move to rotate the rotary body 310 or an instruction to move the boom 203 in a downward direction is being outputted from the control instruction calculation section 343; or the time period after an instruction to move the rotary body 310 or an instruction to move the boom 203 in a downward direction is last outputted and before the remote stop signal receiving section 346 receives the emergency stop signal is equal to or less than the second time period corresponding to the vehicle class information and/or the loaded weight. Also, the avoidance control instruction is an instruction of a movement to change a moving direction of the boom, the arm and the bucket to a predetermined direction avoiding coming into contact with the obstacle, that is, an instruction to move them in a predetermined direction wherein there is no obstacle, during a time period (the third period) corresponding to the vehicle class information and/or the loaded weight, and it includes an instruction to move the boom 203 in an upward direction.

Such determination criteria enables appropriate determination considering length of the free running time.

In Step 406, it may be determined whether there is a construct and/or an obstacle above the work machine, in particular above the work machinery 309. The construct and/or obstacle is, for example, an electric cable, a bridge girder, ceiling in a haulage way, etc.

When the avoiding movement is performed, there is a risk that the work machinery 309 comes into contact with the construct and/or obstacle above it. In order to avoid this, the work machine comprises a position sensor 305 for detecting a position of the work machine. The position sensor 305 is a sensor utilizing, for example, GNSS (Global Navigation Satellite System). Note that, if the position of the work machinery 309 is to be detected, it can be calculated and determined by utilizing the GNSS provided at the work machine and based on the attitude of the work machinery 309 according to the attitude sensor 303.

For movement necessity example, the avoiding determination section 349 determines a movement to change the moving direction to an upward direction, that is, the avoiding movement which is a movement upward wherein there is no obstacle is necessary only if there is no construct and no obstacle above the work machine. Upon determining whether there is a construct and/or an obstacle, first, the position of the work machine obtained by the position sensor 305.

The control device 307 comprises a working area information holding section 347 that holds corresponding relationship between positions in the working area and whether there is a construct and/or an obstacle above each position within the working area. The working area information holding section 347 holds whether there is a construct and/or an obstacle above each position beforehand and it can be determined whether there is the construct and/or obstacle based on the position information of the position sensor 305.

For example, based on the position of the work machine and the corresponding relationship held within the working area information holding section 347, the avoiding movement necessity determination section 349 determines that the avoiding movement is not necessary because there is a risk of coming into contact with the obstacle due to the avoiding movement, regardless of the determination result of Step 405 (that is, regardless of movement situation of the traveling body 311, the rotary body 310 and the work machinery 309) if there is a construct and/or an obstacle above the position of the work machine. If not, it is determined that the avoiding movement is necessary according to the determination result of Step 405.

Such determination suppresses the avoiding movement if there is a construct and/or an obstacle above the work machine. Accordingly, the instruction to move the boom 203 in an upward direction, which has a risk of coming into contact with the construct and/or obstacle, is suppressed and coming into contact with the construct and/or obstacle is avoided.

In Step 407 (that is, in a case wherein it is determined that the avoiding movement is necessary by the avoiding movement necessity determination section 349), the avoidance control instruction section 350 calculates the avoidance control instruction and outputs this to the machine control section 344.

A specific example of the avoidance control instruction will be explained below. The avoidance control instruction includes an instruction to stop the work machinery 309 (excepting the boom 203), the rotary body 310 and the traveling body 311. However, some work machines (for example, a shovel) have great inertia and long braking distance, so the braking might be too late and they might come into contact with an obstacle. Accordingly, in the present step, the avoidance control instruction is an instruction of a movement to change a moving direction of the work machinery 309 to a predetermined direction avoiding coming into contact with the obstacle, that is, an instruction to move it in a predetermined direction wherein there is no obstacle, and it includes an instruction to move the boom 203 to an upward direction in order to let a portion of the work machinery 309 escape upwardly wherein there is no obstacle by changing a moving direction of the work machinery 309 to a predetermined direction avoiding coming into contact with the obstacle, that is, by moving the work machinery 309 in a predetermined direction wherein there is no obstacle. A time period for completing the upward movement of the boom 203 depends on the vehicle size class and the weight of bucket load, so the instruction to move the boom 203 in an upward direction may be constructed so that it continues exactly during a predetermined time period (dt2 in FIG. 4) in proportion to the weight outputted by the loaded weight measurement device 306 and the vehicle class held by the vehicle class information holding section 348. Such control enables appropriate control considering the vehicle class and the loaded weight.

Note that, if abnormality is not detected in Steps 401-403 and the emergency stop signal is not received in Step 404, Step 407 is not performed. Also, if it is determined that the avoiding movement is not necessary in Steps 405-406, Step 407 is not performed.

After the process in FIG. 3, the machine control section 344 controls the rotary body 310, the traveling body 311 and the work machinery 309 putting priority on the avoidance control 1 instruction over the operation control instruction. By this, the risk that the vehicle body comes into contact with an obstacle nearby in a case wherein abnormality arises in the work machine is reduced.

Other Examples

Step 404 may be omitted in Example 1 above. Also, Step 406 may be omitted.

REFERENCE SIGNS LIST

101 Operation input device
102 Control device
103 Work machinery
104 Rotary body
105 Traveling body
106 Control instruction calculation section
107 Machine control section
108 Abnormality detection section
109 Avoiding movement necessity determination section
110 Avoidance control instruction section
202 Rotary body
203 Boom
204 Arm
205 Bucket (Work tool)
206 Traveling body
230 Boom
301 Operation input device
302 Image display device
303 Attitude sensor
304 Remote stop signal transmission device
305 Position sensor
306 Loaded weight measurement device
307 Control device
308 Imaging device
309 Work machinery
310 Rotary body
311 Traveling body
322 Image signal receiving section
324 Operation signal receiving section
331 Image display section
332 Operation signal generation section

333 Operation signal transmission section
341 Image signal transmission section
342 Image signal receiving section
343 Control instruction calculation section
344 Machine control section
345 Abnormality detection section
346 Remote stop signal receiving section
347 Working area information holding section
348 Vehicle size class information holding section
349 Avoiding movement necessity determination section
350 Avoidance control instruction section All publications, patents, and patent applications cited in the present description are incorporated in the present description by being cited as they are.

The invention claimed is:

1. A work machine characterized in that it comprises:
a traveling body;
a rotary body rotatably mounted onto the traveling body;
a work machinery of an articulated type mounted to the rotary body and including a boom, an arm and a work tool; and
a control device,
wherein the control device comprises:
a control instruction calculation section for calculating an operation control instruction to the traveling body, the rotary body and the work machinery in response to an operation instruction outputted from an operation input device;
a machine control section for controlling the traveling body, the rotary body and the work tool in response to an operation control instruction of the control instruction calculation section;
an abnormality detection section for detecting abnormality of a signal from outside of the work machine or abnormality of the work machine;
an avoiding movement necessity determination section for distinguishing movement situation of the traveling body, the rotary body and the work machinery and determining whether an avoiding movement which is a movement to change a moving direction of the work machinery to a predetermined direction avoiding coming into contact with an obstacle, is necessary in a case wherein the abnormality detection section detects abnormality; and
an avoidance control instruction section for calculating an avoidance control instruction and outputs this to the machine control section in a case wherein it is determined that the avoiding movement is necessary by the avoiding movement necessity determination section,
wherein the machine control section controls the traveling body, the rotary body and the work machinery putting priority on the avoidance control instruction over the operation control instruction.

2. A work machine system comprising:
the work machine according to claim 1; and
the operation input device,
wherein the work machine system further comprises an image display device,
wherein the image display device has:
an image signal receiving section for receiving an image signal transmitted by an image signal transmission section; and
an image display section for outputting an image to an operator,
wherein the operation input device is located outside the work machine and receives an input of the operator,
wherein the operation input device comprises:
an operation signal generation section for generating an operation signal in response to an operation of the operator; and
an operation signal transmission section for transmitting the operation signal to the work machine,
wherein the work machine comprises an imaging device for capturing an image around the work machine,
wherein the control device comprises:
an operation signal receiving section for receiving the operation signal transmitted by the operation signal transmission section and outputting this to the control instruction calculation section; and
the image signal transmission section for transmitting the image signal outputted by the imaging device to an outside of the work machine,
wherein the abnormality detection section detects communication delay, communication breakdown or loss of communication data arisen between the operation signal transmission section and the operation signal receiving section or between the image signal transmission section and the image signal receiving section as abnormality.

3. The work machine according to claim 1, wherein
the work machine comprises an attitude sensor for detecting attitude information representing an attitude of the work machine,
the control instruction calculation section of the control device calculates the operation control instruction in response to the attitude information detected by the attitude sensor, and
the abnormality detection section detects signal loss or precision deterioration of the attitude sensor as abnormality.

4. A work machine system comprising the work machine according to claim 1, further comprising a remote stop signal transmission device for transmitting an emergency stop signal that instructs emergency stop of the work machine,
wherein the control device comprises a remote stop signal receiving section for receiving the emergency stop signal, and
wherein the avoiding movement necessity determination section distinguishes movement situation of the traveling body, the rotary body and the work machinery and determines whether avoiding movement is necessary in a case wherein the remote stop signal receiving section receives an emergency stop signal.

5. The work machine according to claim 1,
wherein the avoiding movement necessity determination section determines, in a case wherein the abnormality detection section detects abnormality, that avoiding movement is necessary if:
an instruction to move to rotate the rotary body, an instruction to move to travel the traveling body, or an instruction to move the boom in a downward direction is being outputted from the control instruction calculation section; or
a time period after an instruction to move to rotate the rotary body, an instruction to move to travel the traveling body, or an instruction to move the boom in a downward direction is last outputted and before the abnormality detection section detects abnormality is equal to or less than a first time period,
wherein the avoidance control instruction includes an instruction to move the boom in an upward direction.

6. The work machine system according to claim 4, wherein the avoiding movement necessity determination section determines, in a case wherein the emergency stop signal receiving section receives the emergency stop signal, that avoiding movement is necessary if:

an instruction to move to rotate the rotary body, an instruction to move to travel the traveling body, or an instruction to move the boom in a downward direction is being outputted from the control instruction calculation section; or a time period after an instruction to move to rotate the rotary body, an instruction to move to travel the traveling body, or an instruction to move the boom in a downward direction is last outputted and before the remote stop signal receiving section receives the emergency stop signal is equal to or less than a first time period, wherein the avoidance control instruction includes an instruction to move the boom in an upward direction.

7. The work machine according to claim 1, wherein the control device comprises a vehicle size class information holding section for holding vehicle size class information of the work machine, wherein the work machine comprises a loaded weight measurement device for detecting a loaded weight of a load that is loaded into the work machine, wherein the avoiding movement necessity determination section determines, in a case wherein the abnormality detection section detects abnormality, that avoiding movement is necessary if:

an instruction to move to rotate the rotary body or an instruction to move the boom in a downward direction is being outputted from the control instruction calculation section; or a time period after an instruction to move to rotate the rotary body or an instruction to move the boom in a downward direction is last outputted and before the abnormality detection section detects abnormality is equal to or less than a second time period corresponding to the vehicle size class information and the loaded weight, wherein the avoidance control instruction includes an instruction to move the boom in an upward direction during a third time period corresponding to the vehicle size class information and the loaded weight.

8. The work machine system according to claim 4, wherein the control device comprises a vehicle size class information holding section for holding vehicle size class information of the work machine, wherein the work machine comprises a loaded weight measurement device for detecting a loaded weight of a load that is loaded into the work machine, wherein the avoiding movement necessity determination section determines, in a case wherein the emergency stop signal receiving section receives the emergency stop signal, that avoiding movement is necessary if:

an instruction to move to rotate the rotary body or an instruction to move the boom in a downward direction is being outputted from the control instruction calculation section; or a time period after an instruction to move to rotate the rotary body or an instruction to move the boom in a downward direction is last outputted and before the remote stop signal receiving section receives the emergency stop signal is equal to or less than a second time period corresponding to the vehicle size class information and the loaded weight, wherein the avoidance control instruction includes an instruction to move the boom in an upward direction during a third time period corresponding to the vehicle information and the loaded weight.

9. The work machine according to claim 7, wherein the avoidance control instruction outputted during the third time period includes an instruction to move an arm and a work tool in a pull direction.

10. The work machine according to claim 1, wherein the work machine comprises a position sensor for detecting a position of the work machine, wherein the control device comprises a working area information holding section for holding corresponding relationship between the position and whether there is a construct or an obstacle above the position, wherein the avoiding movement necessity determination section determines that the avoiding movement is not necessary based on the position and the corresponding relationship regardless of the movement situation of the traveling body, the rotary body and the work machinery if there is a construct or an obstacle above the position.

* * * * *